US005657820A

United States Patent [19]

Bailey et al.

[11] Patent Number: 5,657,820

[45] Date of Patent: Aug. 19, 1997

[54] TWO TRIP WINDOW CUTTING SYSTEM

[75] Inventors: Thomas F. Bailey, Pebblebrook; John E. Campbell, Houston; Joseph V. Hebert, Tomball, all of Tex.

[73] Assignee: Smith International, Inc., Houston, Tex.

[21] Appl. No.: 572,592

[22] Filed: Dec. 14, 1995

[51] Int. Cl.[6] ..... E21B 7/08

[52] U.S. Cl. ..... 166/55.7; 166/117.6; 175/80; 175/386

[58] Field of Search ..... 166/55.7, 117.6, 166/298; 175/386, 385, 391, 79, 80, 81, 82

[56] References Cited

U.S. PATENT DOCUMENTS

| | | | |
|---|---|---|---|
| 1,387,447 | 8/1921 | Alford . | |
| 1,454,048 | 5/1923 | Esperson | 166/298 |
| 1,636,032 | 7/1927 | Abbott | 166/117.6 |
| 1,795,553 | 3/1931 | Getty | 166/117.6 |
| 2,105,722 | 1/1938 | Barrett et al. | 175/81 |
| 2,124,414 | 7/1938 | Goldman . | |
| 3,330,349 | 7/1967 | Owsley et al. . | |
| 4,266,621 | 5/1981 | Brock . | |
| 4,397,360 | 8/1983 | Schmidt . | |
| 5,109,924 | 5/1992 | Jurgens et al. . | |
| 5,113,938 | 5/1992 | Clayton . | |
| 5,199,513 | 4/1993 | Stewart et al. . | |
| 5,277,251 | 1/1994 | Blount et al. . | |
| 5,445,222 | 8/1995 | Pritchard et al. . | |

*Primary Examiner*—Hoang C. Dang

*Attorney, Agent, or Firm*—Robert M. Vargo; Robert G. Upton

[57] ABSTRACT

A two trip sidetrack casing milling apparatus for elongating and enlarging a previously formed window in a cased borehole in preparation for a subsequent sidetracking drilling operation is disclosed. The apparatus consists of three mills on a shaft, a first window mill is secured to an end of a shaft. The first window mill forms a diameter larger than a diameter of a subsequent sidetracking drill bit that is passed through the window. A second pilot mill is secured to the shaft and strategically positioned above the first window mill. The second pilot mill forms a diameter that is less than the diameter of the first window mill. A third watermelon mill is secured to the shaft and strategically positioned above the second pilot mill. The third watermelon mill forms a diameter that is at least the same diameter as the first window mill. The second, smaller in diameter pilot mill serves to move toward the window thereby straightening the shaft while further cutting a portion of the casing surrounding the window thus assuring a more stable and accurate sidetrack direction. The third watermelon mill serves to dregs the window in the casing after the first window mill and the second pilot mill pass through the casing.

14 Claims, 4 Drawing Sheets

TWO TRIP WINDOW CUTTING SYSTEM

BACKGROUND OF THE INVENTION

1. Field of the Invention

This invention relates to a device and method for drilling a secondary borehole from an existing cased borehole in geologic formations.

More particularly, this invention comprises a three-in-one milling tool which has improved features when compared to prior art sidetrack casing milling operations.

2. Background

Previously drilled and cased wellbores, for one reason or another, may become non-productive. When a wellbore becomes unusable, a new borehole may be drilled in the vicinity of the existing cased borehole or alternatively, a new borehole may be sidetracked from the bottom of a serviceable portion of the cased borehole.

Sidetracking is often preferred because drilling, casing and cementing the borehole is avoided. Sidetracking involves milling through a steel pipe casing and should be accomplished without a major change in direction or dog leg in the borehole. This procedure is generally accomplished by either milling out an entire section of pipe casing followed by drilling through the side of the exposed borehole, or by drilling through the side of the casing with a mill bit that is guided by a wedge or "whipstock" component.

Drilling a sidetracked hole through a pipe casing is difficult and often results in unsuccessful penetration of the casing and destruction of the whipstock. In addition, if the window is improperly cut, a severely deviated dog leg may be the result rendering the sidetracking operation unusable.

Several patents relate to methods and apparatus to sidetrack through a cased borehole. U.S. Pat. No. 4,266,621 describes a diamond milling cutter for elongating a laterally directed opening window in a well pipe casing that is set in a borehole in an earthen formation. The mill bit has one or more eccentric lobes that engage the angled surface of a whipstock and cause the mill to revolve on a gyrating or non-fixed axis and effect oscillation of the cutter center laterally of the edge thus enhancing the pipe casing cutting action.

The foregoing system normally requires three trips in the sidetracking operation. A first stage begins a window in the well pipe casing, a second stage extends the window through use of a diamond milling cutter and a third stage with multiple mills elongates and extends the window.

While the window mill is aggressive in opening a window in the pipe casing, the number of trips required to complete the sidetracking operation (3) is expensive and time consuming.

U.S. Pat. No. 5,109,924 teaches a one trip window cutting operation to sidetrack a wellbore. A deflection wedge guide is positioned behind the pilot cutter and adjacent the end of the whipstock component. The pilot cutting tool or pipe casing mill is in such a position in the borehole that its frontal cutting surface does not come to rest on the ramped surface of the whipstock. In theory, the deflection wedge guide surface takes over the guidance of the cutting tool without the whipstock ramp surface being destroyed.

However, when a second and third milling tool of the same diameter and spaced one from the other a short distance behind the pilot mill, contacts the whipstock ramp, they mill away the guide. This inhibits or interferes with the pilot mill from sidetracking at a proper angle with respect to an axis of the cased borehole and may cause the pilot mill to contact the ramp surface of the whipstock before the cutter mill dears the pipe casing. The reamers or mills aligned behind the pilot mill having a diameter the same as (or larger than) the diameter of the pilot mill, prevents or inhibits the pilot mill from exiting the pipe casing easily. This is due to the lack of clearance space and flexibility of the drill pipe assembly making up the one trip window cutting tool when each of the following reamer mills sequentially contact the window in the casing. Hence, the sidetracking apparatus tends to mill straight.

U.S. Pat. No. 5,445,222 teaches a combination whipstock and staged sidetrack mill. A pilot mill spaced from and located on a common shaft above a tapered cutting end is, at its largest diameter, between 50 percent and 75 percent of the final sidetrack window diameter. A second stage cutting surface positioned on the same shaft and above the pilot mill being, at its smallest diameter, about the diameter of the maximum diameter of the pilot mill, and being, at its largest diameter, at least five percent greater in diameter than the largest diameter of the pilot mill. A final stage cutting surface, also on the same shaft, being at its largest diameter, about the final diameter, and at the smallest cutting surface diameter, being a diameter of at least about 5 percent smaller than the final diameter. The sidetracking mill is designed to accomplish the milling operation in one trip. The mill however, tends to go straight and penetrate the whip hence, the material of the whip must be harder than the casing to affect sidetrack. Otherwise, substantial damage to the whipface will occur and sidetracking may not occur as a result.

While the intent is to perform a sidetracking operation in one trip, difficulties often arise when attempting to deviate the drill string from its original path to an off line sidetracking path. Progressively larger in diameter reaming stages to enlarge the window inhibits the drill shaft from deviating or flexing sufficiently to direct the drill pipe in a proper direction resulting in damage to the whipstock and misdirected sidetracked boreholes. In other words, the sidetracking assembly tends to go straight rather than deviate through the steel casing.

SUMMARY OF THE INVENTION

It is an object of this invention to provide a means to precisely sidetrack a drill string through a window cut in a cased borehole.

More particularly, it is an object of this invention to provide a two trip pipe casing mill system for sidetracking operations that is flexible enough to mill through the pipe casing yet stiff enough to dress and elongate the window through the casing.

When a sidetracking operation is initiated, a conventional whipstock well known in the art, is located, oriented and set in a cased borehole on a first trip. Since the whipstock is typically connected to a starter mill through shear bolt(s), once the whipstock is set in the cased hole, the starter mill is sheared from the deflection wedge on the wedge-shaped whip and subsequently directed through the casing wall by the deflection wedge. Once the window through the pipe casing is formed, the starter mill is tripped out of the hole.

On the second trip, a milling tool consisting of a single piece body with a leading, full gage diameter window mill, a second undergage pilot mill spaced from and above the window mill and a third full gage "watermelon" mill strategically positioned above the pilot mill.

The second undergage pilot mill allows sufficient deflection of the one piece tool to allow the window mill to sidetrack through the window without damage to the whipstock. In addition, the second undergage pilot mill starts milling the window above the location cut by the starter mill and window. This effectively begins a staged elongation of the window.

The following, full gage, watermelon mill further elongates and dresses the window to accept a drilling assembly with a drill bit to complete the sidetracking operation once the milling tool is tripped out of the cased borehole.

The one piece milling tool eliminates a third trip milling operation.

The aforementioned prior art all attempt to flex the sidetracking milling apparatus between full gage (or larger) diameter mill cutters, spaced one from the other, on a shaft to force the window cutters through the pipe casing. This is done, for example, by reducing the diameter of the mill cutter supporting shaft between the staged cutters or reamers in an attempt to find flexibility. By so doing, the shaft is weakened and the desired flexibility, for the most part, is still lacking.

The present invention provides clearance for the staged window reaming operation without excessively flexing the one piece shaft supporting the window mill, undergage pilot mill and the watermelon mill that dresses the window to full gage. The undergage pilot mill allows the shaft and window mill to proceed through the window in the casing and into the formation without damage to the whipstock and with the proper borehole angulation for the follow-on sidetracking operation.

A two trip sidetrack casing milling apparatus for elongating and enlarging a previously formed window in a cased borehole in preparation for a subsequent sidetracking drilling operation is disclosed. The apparatus consists of three mills on a shaft, a first window mill is secured to an end of a shaft. The first window mill forms a diameter larger than a diameter of a subsequent sidetracking drill bit that is passed through the window. A second pilot mill is secured to the shaft and strategically positioned above the first window mill. The second pilot mill forms a diameter that is less than the diameter of the first window mill. A third watermelon mill is secured to the shaft and strategically positioned above the second pilot mill. The third watermelon mill forms a diameter that is at least the same diameter as the first window mill. The second, smaller in diameter pilot mill serves to move toward the window thereby straightening the shaft while further cutting a portion of the casing surrounding the window thus assuring a more stable and accurate sidetrack direction. The third watermelon mill serves to dress the window in the casing after the first window mill and the second pilot mill pass through the casing.

An advantage then of the present invention over the prior art is the means in which the two trip window milling operation moves through the window formed in the pipe casing without damage to the whipstock.

Another advantage of the present invention over the prior art is the structural integrity of the one piece mill system as it moves through a window formed in a pipe casing. The unique undergage intermediate pilot mill allows the window mill to maneuver through the window and follow the path of the whip without any tendency to mill up the whip thus assuring accurate sidetracking alignments.

The above noted objects and advantages of the present invention will be more fully understood upon a study of the following description in conjunction with the detailed drawings.

BRIEF DESCRIPTION OF THE PREFERRED EMBODIMENTS AND BEST MODE FOR CARRYING OUT THE INVENTION

Figure 1:
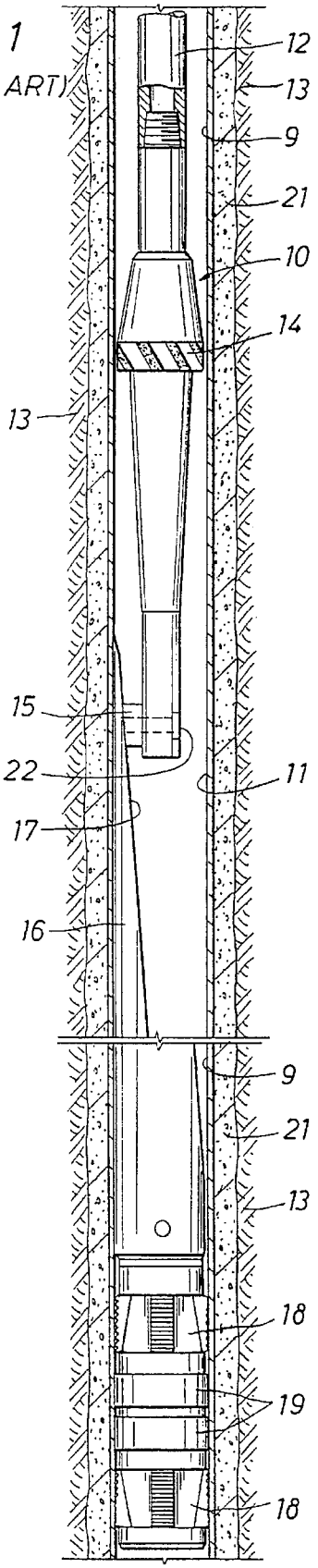
FIG. 1 (PRIOR ART)
FIG. 1 is a partial cross-sectional view of a prior art sidetracking operation depicting setting the packer of a whipstock sidetracking system in a steel pipe cased borehole.

Referring now to the prior art of FIG. 1, the casing sidetrack system generally designated as 10 consists of a drill collar 12 attached to a starter mill 14. The starter mill 14 is affixed to the end of a whipstock 16 through a shear bolt block 15. The whipstock 16 has an anchor 18 attached to the downhole end of the whipstock. The entire assembly is tripped into a borehole 9. After the sidetracking system reaches a desired depth in the borehole 9, the whipstock 16 is oriented to a desired sidetrack angulation and set or anchored in the steel pipe casing 11. The whipstock anchor may include a seal 19 to isolate the wellbore below the packer 18 from a new sidetracked bore.

Figure 2:
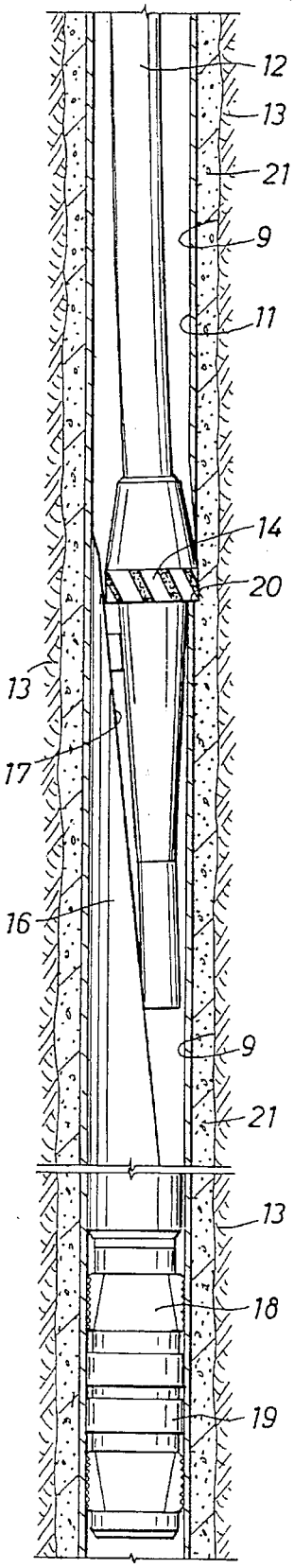
FIG. 2 (PRIOR ART)
FIG. 2 is a partial cross-sectional view of a first stage of the prior art sidetracking operation illustrating cutting a window section in a pipe casing with a starter mill.

With reference to the prior art of FIG. 2, once the system 10 is properly oriented and set in the easing 11, the starter mill is released from the end of the whipstock 16 by breaking the shear pin 22 secured to the shear bolt block 15. The starter mill 14 is subsequently directed into casing by shear bolt block 15 along ramped surface 17 formed by the whipstock 16. The starter mill then mills a window 20 through a wall of the steel casing 11. After the starter mill 14 begins the window 20 it is tripped out of the cased borehole 9.

Figure 3:
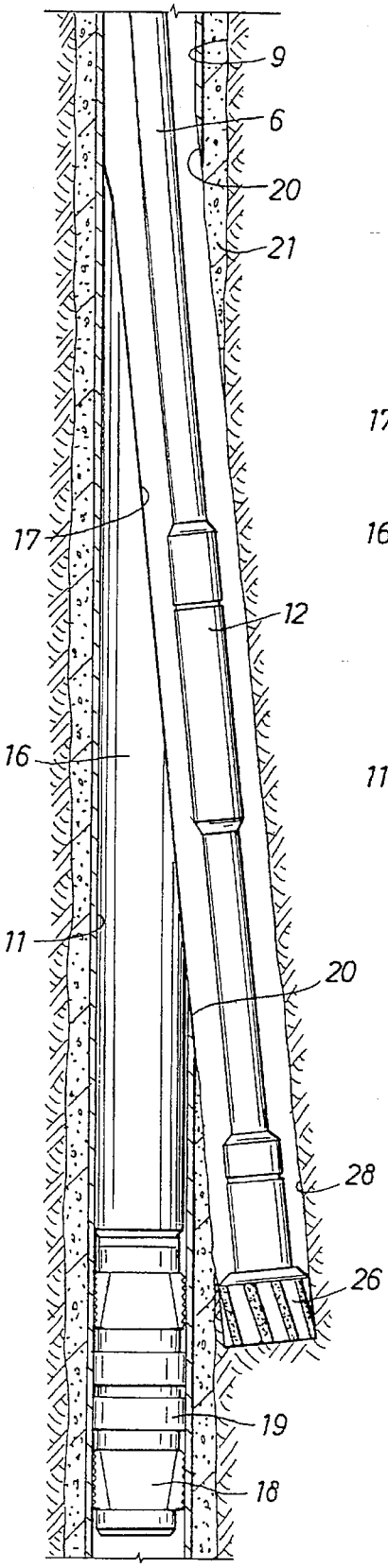
FIG. 3 (PRIOR ART)
FIG. 3 is a partial cross-sectional view of a second stage of the prior art sidetracking operation showing the cutting of an elongated window section in the pipe casing.

The prior art of FIG. 3 depicts phase two of the sidetracking operation. A window mill 26 is attached to the end of the drill collar 12 and directed through window 20 cut by starter mill 14. The window mill 26 completes the window 20 in preparation for a subsequent sidetrack drilling operation. The window mill 26 is tripped out of the borehole 9 after it completes the window.

Figure 4:
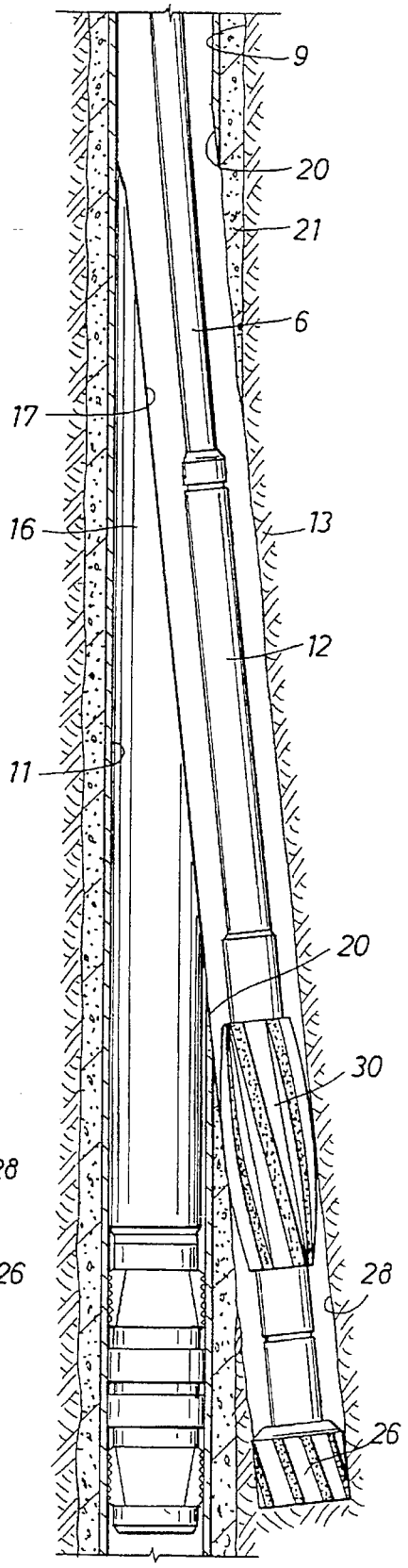
FIG. 4 (PRIOR ART)
FIG. 4 is a partial-cross sectional view of a third stage of the prior art sidetracking operation illustrating the final window dressing procedure utilizing a watermelon mill.

FIG. 4 illustrates phase three of the prior art sidetracking system 10 whereby a watermelon mill 30 (so called for its shape) is attached between the end of the collar 12 and the window mill 26. The sidetracking system is again tripped back into the cased borehole 9 and directed through the enlarged window 20. The watermelon mill 30 dresses and elongates the window 20 to fully prepare the window through the casing 11. The watermelon mill and the window mill attached to collar 12 is then tripped out of the borehole.

A subsequent sidetracking drilling operation would, for example, utilize a conventional three cone rock bit that is directed through the finished window 20 into the sidetracked borehole 28. Drilling continues until the desired depth is reached.

Figure 5:
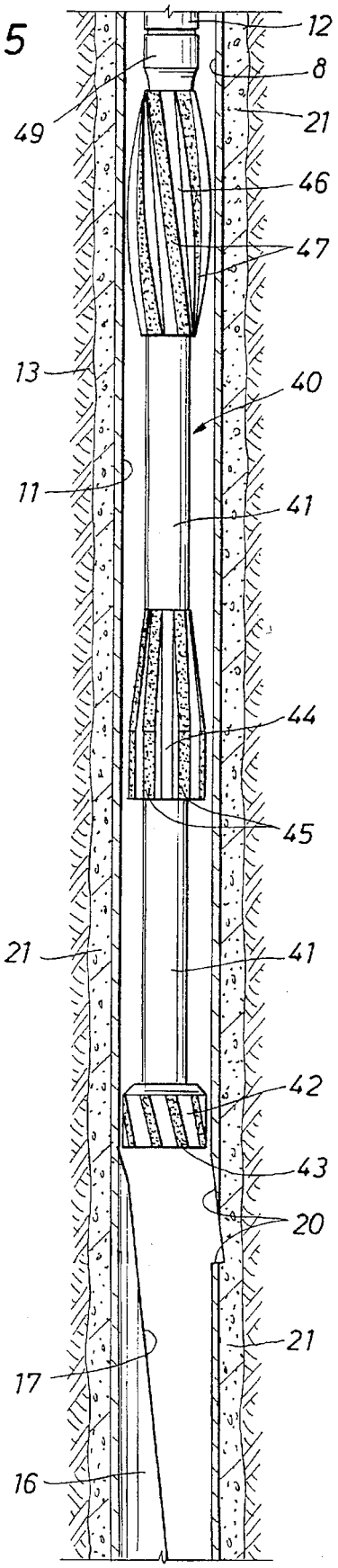
FIG. 5 is a schematically illustrated side view of the three-in-one sidetrack mill showing the ratios of lengths between each of the milling tools strategically positioned along the one piece shank of the tool and the ratio of diameters of each of the mills as they relate to one another.

FIG. 5 illustrates a preferred embodiment of the invention wherein the three-in-one sidetrack mill generally designated as 40 consists of a mill shank 41 that supports a window mill 42, a pilot mill 44 spaced behind the window mill and a watermelon mill 46 spaced from and behind the pilot mill. A box connection 49 is formed at the end of shank 41 opposite to the window mill 42.

Normally, a heavy weight drill pipe or collar 12 connects to box end 49 and to the end of the drill string (not shown). The drill collars provide weight, rigidity and stability down hole and depend on the parameters of the cased borehole to determine the size and weight of the drill collar.

Figure 6:
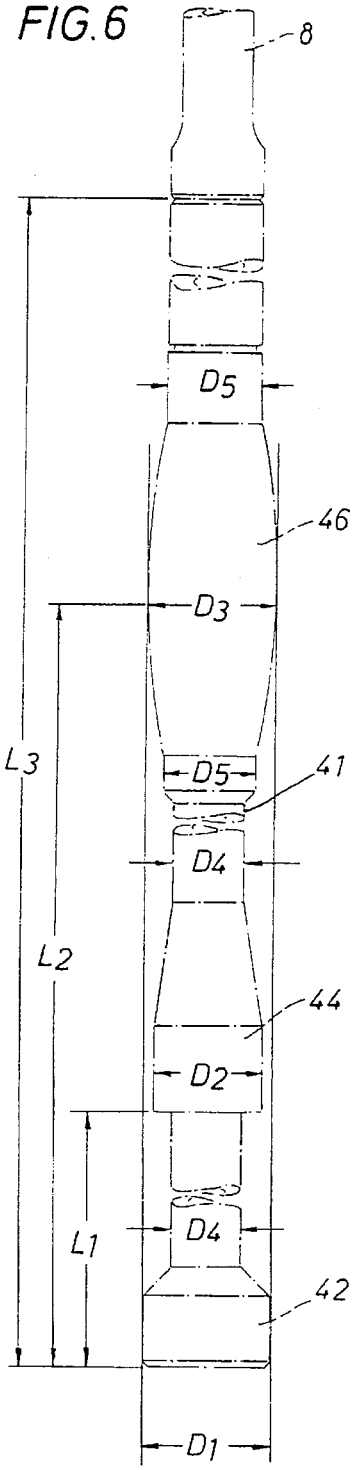
FIG. 6 is a side elevational view of a one piece side tracking mill of the present invention in a cased borehole illustrating a full gage window mill, an undergage pilot mill spaced from and behind the window mill and a full gage watermelon mill strategically spaced from and behind the pilot mill.

FIG. 6 schematically depicts the three-in-one sidetrack mill 40 wherein L3 represents the total length of the mill, L2 is the distance between the cutting end 43 of window mill 42 and the middle or high point 48 of watermelon mill 46 and L1 represents the distance between end 43 and the cutting edge of blades 45 of the undergaged pilot mill 44. D1 is the gage diameter of the window mill 42, D2 is the diameter of the pilot mill 44 and D3 represents the diameter of the watermelon mill 46. D4 is the diameter of the shaft or mill shank 41 below the watermelon mill 46 and D5 is the diameter of the shaft above the watermelon mill 46.

The following percentages relate to the foregoing dimensions:

L1/L2=25%/40%

D2/D1=90%/94%

D4/D5=87%/89%

D1/D3=100%

D1/D3=96%/100% (where "special drift" pipe casing is utilized as explained below)

The diameter of the window mill and the diameter of the watermelon mill are the same (with one exception) while the diameter of the pilot mill is less than the diameter of either the window mill or the watermelon mill (D2/D1=90%/94%).

The only exception is when "special drift" pipe casing is utilized. For example, if a 9.625 inch 53.5 lbs. per foot special drift pipe casing is used, the internal diameter (I.D.) of the casing is 8.500 inch throughout the length of the casing. In this circumstance, the diameter of the watermelon mill would be 8.500 (an eighth of an inch larger in diameter than the window mill diameter of 8.375 inch. as represented by D1/D3=96%/100%). The larger in diameter watermelon mill opens up the window 20 to accept a larger in diameter sidetracking drill bit that passes through the special drift pipe casing (not shown).

The I.D. drift of ordinary 9.625 inch pipe casing varies from 8.375 to 8.531 of an inch hence the preferred diameter ratio between the window mill and the watermelon mill is one to one since a smaller in diameter drill bit must be used for the subsequent sidetracking operation due to the I.D. anomalies in the ordinary 9.625 inch pipe casing.

An example of a three-in-one sidetracking mill of the present invention utilized in 9⅝ inch pipe casing would have the following dimensions:

L1=37 15/16 inch

L2=123 1/16 inch

D1=8⅜ inch

D2=7¾ inch

D3=8⅜ inch

D4=5.375 inch

D5=6.250 inch

Figure 7:
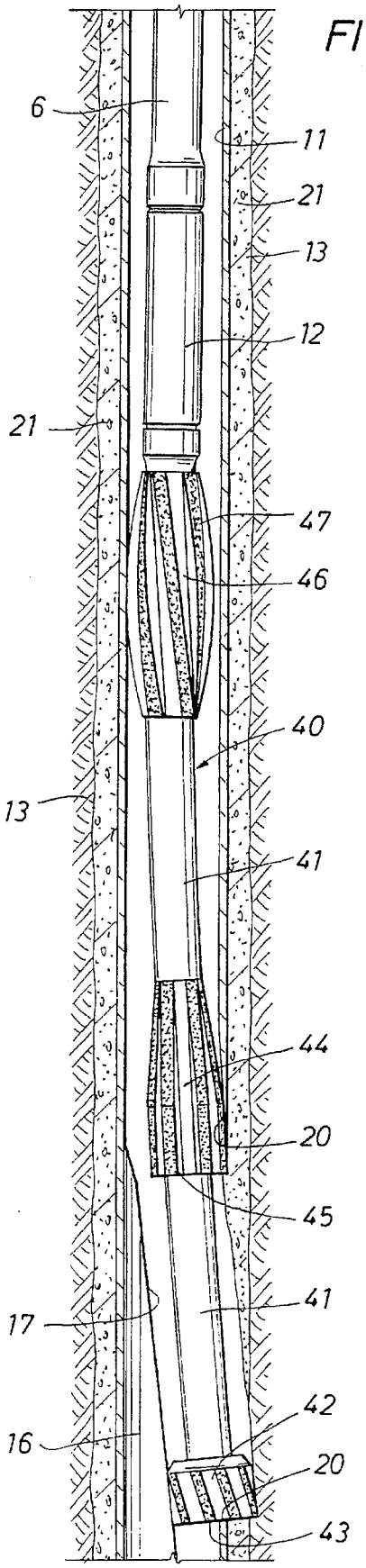
FIG. 7 is a partial cross-section of the one piece mill of the present invention positioned in the cased borehole showing the window mill cutting a full gage window in the pipe casing and the pilot mill, biased away from the angled whipstock surface, coming into cutting contact with the casing.

Referring now to FIGS. 6 and 7, the mill assembly 40 is positioned in the cased borehole 9 just above the window 20 cut by the starter mill 14 (FIG. 2). The window mill 42 is biased through the window 20 by the ramp surface 17 formed by whipstock 16. As the window mill advances through the opening 20, the watermelon mill 46 acts as a pivot when the mill 46 contacts the inside wall of the steel casing 8 thereby driving pilot mill 44 against the inside surface of the casing adjacent the window 20 (see FIG. 7). Since the diameter of the pilot mill is smaller in diameter than the leading window mill 42, it allows the shank supporting the three mills 42, 44 and 46 to straighten out. The smaller size of the intermediate pilot mill 44 is biased by the slightly bent shank 41 toward the window opening 20 thereby stabilizing the mill assembly 40 for a more accurate sidetracking operation.

Figure 8:
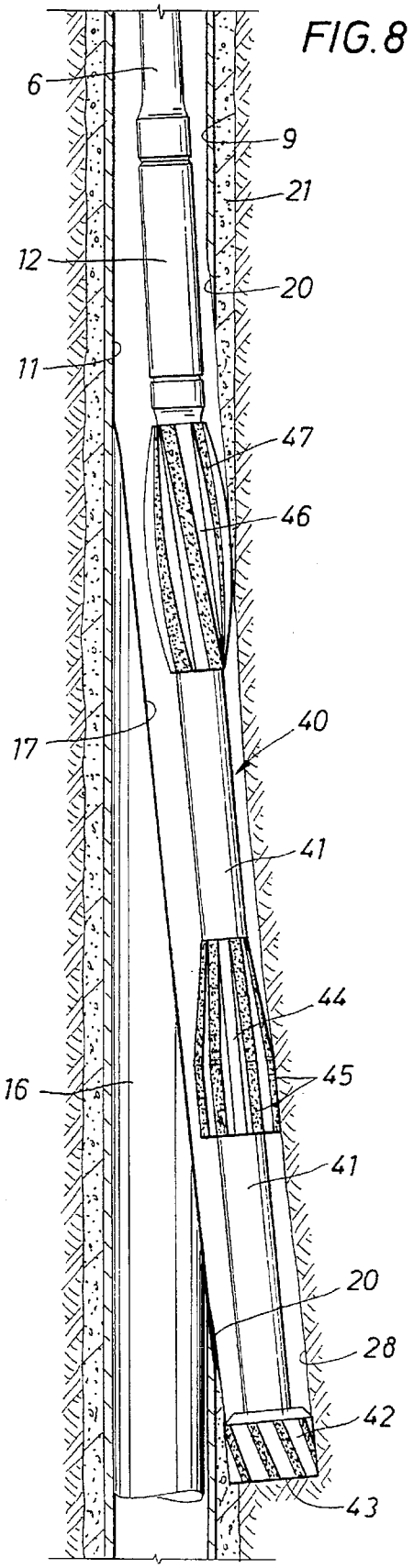
FIG. 8 is a partial cross-section of the one piece mill advanced through the window formed in the steel casing illustrating the watermelon mill starting to elongate and dress the window to full gage in final preparation of the window for subsequent sidetracking drilling operations.

FIG. 8 depicts the window mill 42 well advanced in the sidetracked borehole 28, the watermelon mill 46 just beginning to dress the window 20. Once the 3 in 1 sidetrack mill assembly 40 proceeds all the way through the window 20, the assembly is tripped from the borehole 8 for subsequent sidetracking drilling operations as heretofore mentioned.

The spiral blades 47 of watermelon mill 46, cutting blades 45 of pilot mill 44 and the cutting end 43 of window mill 42 are typically hardfaced with a tungsten carbide containing matrix that is well suited to cutting through metals such as the steel casing 8. It should be noted however that other cutting elements may be used with each of the mills such as tungsten carbide inserts, diamond inserts or a matrix including polycrystalline diamond without departing from the scope of this invention.

Figure 9:
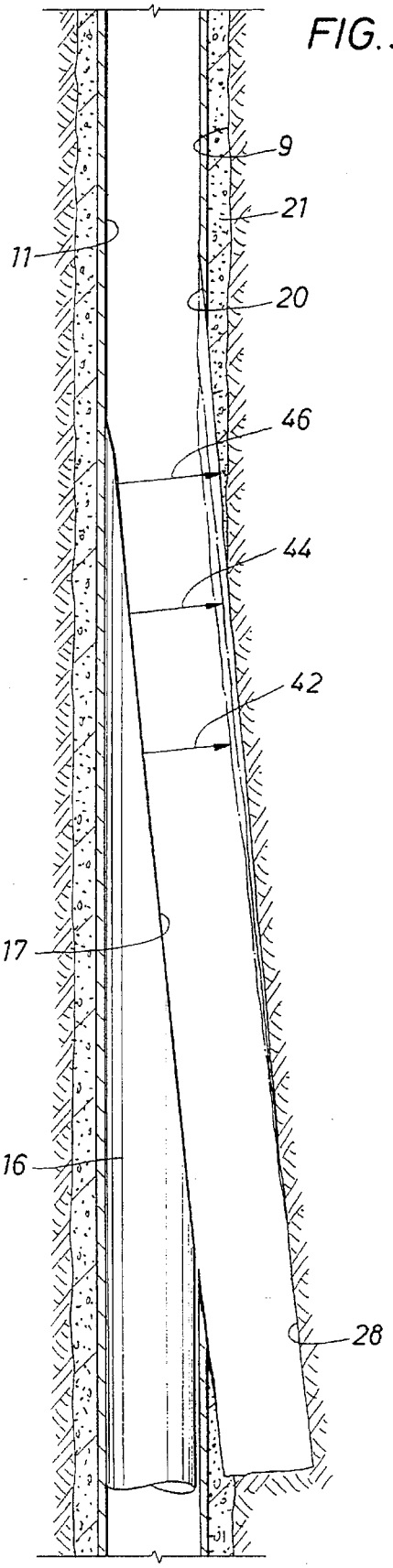
FIG. 9 is a diagrammatic illustration of the cutting path of each of the mills of the present invention as they cut through the window opening defined by the steel pipe casing.

FIG. 9 demonstrates the cutting path of each of the mills 42, 44 and 46 as they sequentially proceed through the window 20.

It will of course be realized that various modifications can be made in the design and operation of the present invention without departing from the spirit thereof. Thus while the principal preferred construction and mode of operation of the invention have been explained in what is now considered to represent its best embodiments which have been illustrated and described, it should be understood that within the scope of the appended claims the invention may be practiced otherwise than as specifically illustrated and described.

What is claimed is:

1. A sidetrack casing milling apparatus for elongating and enlarging a previously formed window in a cased borehole in preparation for a subsequent sidetracking drilling operation comprising;

a first window mill secured to an end of a shaft, a second pilot mill secured to the shaft and strategically positioned above the first window mill, the second pilot mill forming a diameter that is less than the diameter of the first window mill, and a third mill secured to the shaft and strategically positioned above the second pilot mill, the third mill forming a diameter that is at least the same diameter as the first window mill, the second, smaller in diameter pilot mill moves toward the window as the window mill advances into a sidetrack borehole thereby straightening the shaft while further cutting a portion of the casing surrounding the window thus assuring a more stable and accurate sidetrack direction, the third mill serves to elongate and dress the window in the casing after the first window mill and the second pilot mill pass through the casing.

2. The invention as set forth in claim 1 wherein the distance between a cutting end formed by the first window mill and a cutting end formed by the second pilot mill is 25 to 40 percent of the distance between the cutting end of the window mill and a cutting surface formed by the third mill.

3. The invention as set forth in claim 1 wherein the diameter of the second pilot mill is 90 to 94 percent of the diameter of the first window mill.

4. The invention as set forth in claim 1 wherein the diameter of the third mill is at least 100 percent of the diameter of the first window mill.

5. The invention as set forth in claim 1 wherein the diameter of the first window mill is 96 percent of the diameter of the third mill when an interior diameter of a pipe casing connected to the sidetrack casing milling apparatus is substantially constant thereby allowing a larger diameter drill bit through the window during the subsequent sidetracking drilling operation.

6. The invention as set forth in claim 1 wherein the diameter of the shaft is 87 to 89 percent of the diameter of a drill pipe component connected to the sidetrack casing milling apparatus.

7. The invention as set forth in claim 6 wherein the drill pipe component is a drill collar.

8. The invention as set forth in claim 6 wherein the drill pipe component is a heavy weight drill collar.

9. The invention as set forth in claim 1 wherein the third mill is shaped like a watermelon, a main cutting surface formed by a body of the mill is positioned about midway between a reduced in diameter upper and lower end of the mill secured to the shaft.

10. The invention as set forth in claim 1 wherein the first window mill, the second pilot mill and the third mill form cutting blades on a surface formed by the mills, the blades having an ultra hard material formed thereon.

11. The invention as set forth in claim 10 wherein the ultra hard material is a matrix of tungsten carbide.

12. The invention as set forth in claim 10 wherein the ultra hard material is a matrix of tungsten carbide and diamond.

13. The invention as set forth in claim 12 wherein the diamond is polycrystalline diamond.

14. A sidetrack casing milling apparatus for elongating and enlarging a previously formed window in a cased borehole in preparation for a subsequent sidetracking drilling operation comprising;

a first mill cutter secured at one end of a shaft, the first mill cutter forming a diameter larger than a diameter of a sidetracking drill bit that is subsequently passed through the window, a second mill cutter secured to the shaft and strategically positioned above the first mill cutter, said second mill cutter forming a diameter that is less than the diameter of the first mill cutter, and a third watermelon shaped mill cutter secured to the shaft and strategically positioned above the second mill cutter, the third mill cutter forming a diameter that is at least the same diameter as the first mill cutter, the second, smaller in diameter, mill cutter positioned between the first and third mill cutters is biased toward the window in the casing thereby straightening out the shaft that is being diverted through the window while cutting a portion of the casing surrounding the window thus assuring a more stable and accurate sidetracked borehole direction, the third mill cutter serves to dress the window in the casing.

* * * * *